United States Patent [19]

Beck et al.

[11] Patent Number: 4,719,453

[45] Date of Patent: Jan. 12, 1988

[54] CARD CARRIER HAVING AN ALARM

[75] Inventors: Steven B. Beck, San Rafael, Calif.; Albert Wong, Kowloon, Hong Kong

[73] Assignee: Kwik Find, Ltd., San Rafael, Calif.

[21] Appl. No.: 866,382

[22] Filed: May 23, 1986

[51] Int. Cl.[4] ..... G08B 13/00; G08B 13/14

[52] U.S. Cl. ..... 340/568; 250/222.1

[58] Field of Search ..... 340/568, 555, 571; 250/222.1

[56] References Cited

U.S. PATENT DOCUMENTS

| | | | |
|---|---|---|---|
| 2,230,173 | 1/1941 | Weir . | |
| 2,708,747 | 5/1955 | Moon . | |
| 3,076,897 | 2/1963 | Skirvin | 340/555 X |
| 3,226,705 | 12/1965 | Kaufman et al. . | |
| 3,273,023 | 9/1966 | Meyer . | |
| 3,300,770 | 1/1967 | Brousseau et al. . | |
| 3,815,118 | 6/1974 | McDonald . | |
| 3,930,249 | 12/1975 | Steck et al. . | |
| 3,959,789 | 5/1976 | McGahee . | |
| 4,042,918 | 8/1977 | Klitzman . | |
| 4,223,296 | 9/1980 | Kim et al. . | |
| 4,480,250 | 10/1984 | McNeely | 340/568 |
| 4,558,307 | 12/1985 | Lienart van Lidt de Jeude | 340/568 X |

FOREIGN PATENT DOCUMENTS

46568/85 2/1986 Australia .

*Primary Examiner*—James L. Rowland
*Assistant Examiner*—Brian R. Tumm
*Attorney, Agent, or Firm*—Saidman, Sterne, Kessler & Goldstein

[57] ABSTRACT

The present invention provides a card carrier such as a wallet for reducing the occurrence of loss of a card such as a credit card. The card carrier includes an arrangement for receiving a card and for triggering an alarm when (i) the card is missing from the card carrier, and (ii) the card carrier is placed in an enclosure such as one's pocket or purse. The arrangement for receiving a card and for triggering an alarm includes a pocket arrangement normally adapted to receive a card therein, a card sensing mechanism associated with the pocket arrangement for detecting the presence or absence of a card therein, and an enclosure sensing mechanism for sensing when the card carrier is placed in one's pocket, purse, or other enclosure. An alarm mechanism operatively connected to the card sensing mechanism and the enclosure sensing mechanism is provided for emitting an alarm signal when the card sensing mechanism detects the absence of a card from the pocket and the enclosure sensing mechanism senses the card carrier is positioned in one's pocket, purse, or other enclosure.

40 Claims, 6 Drawing Figures

FIG. 1
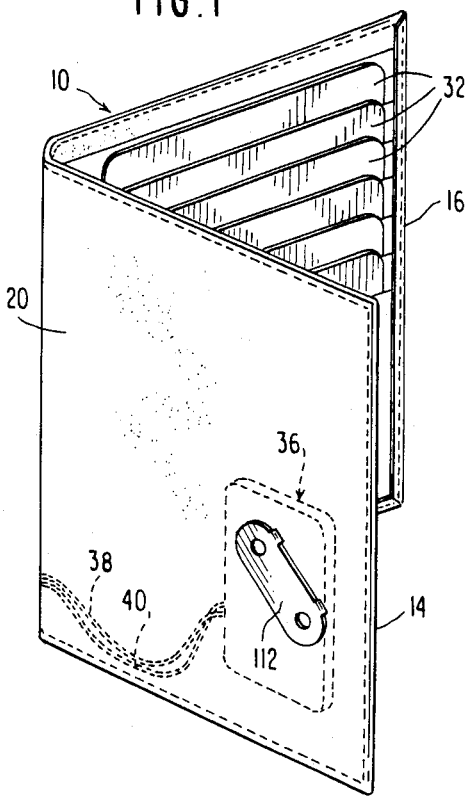
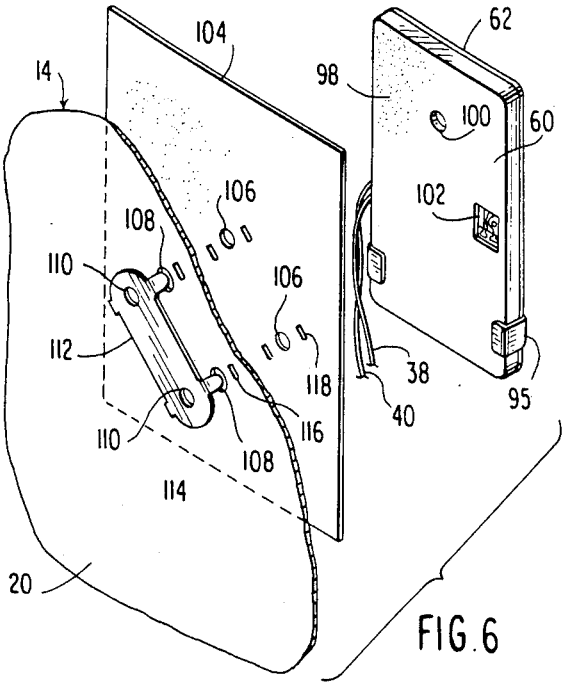
FIG. 6
FIG. 2
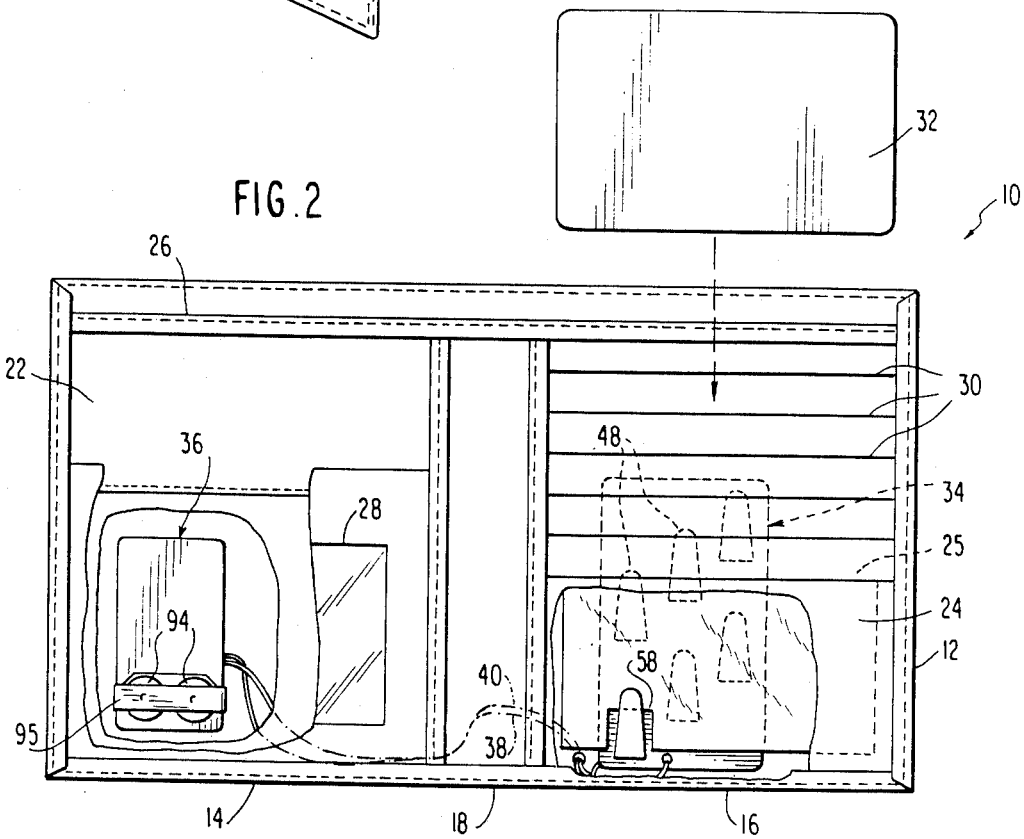

FIG. 4
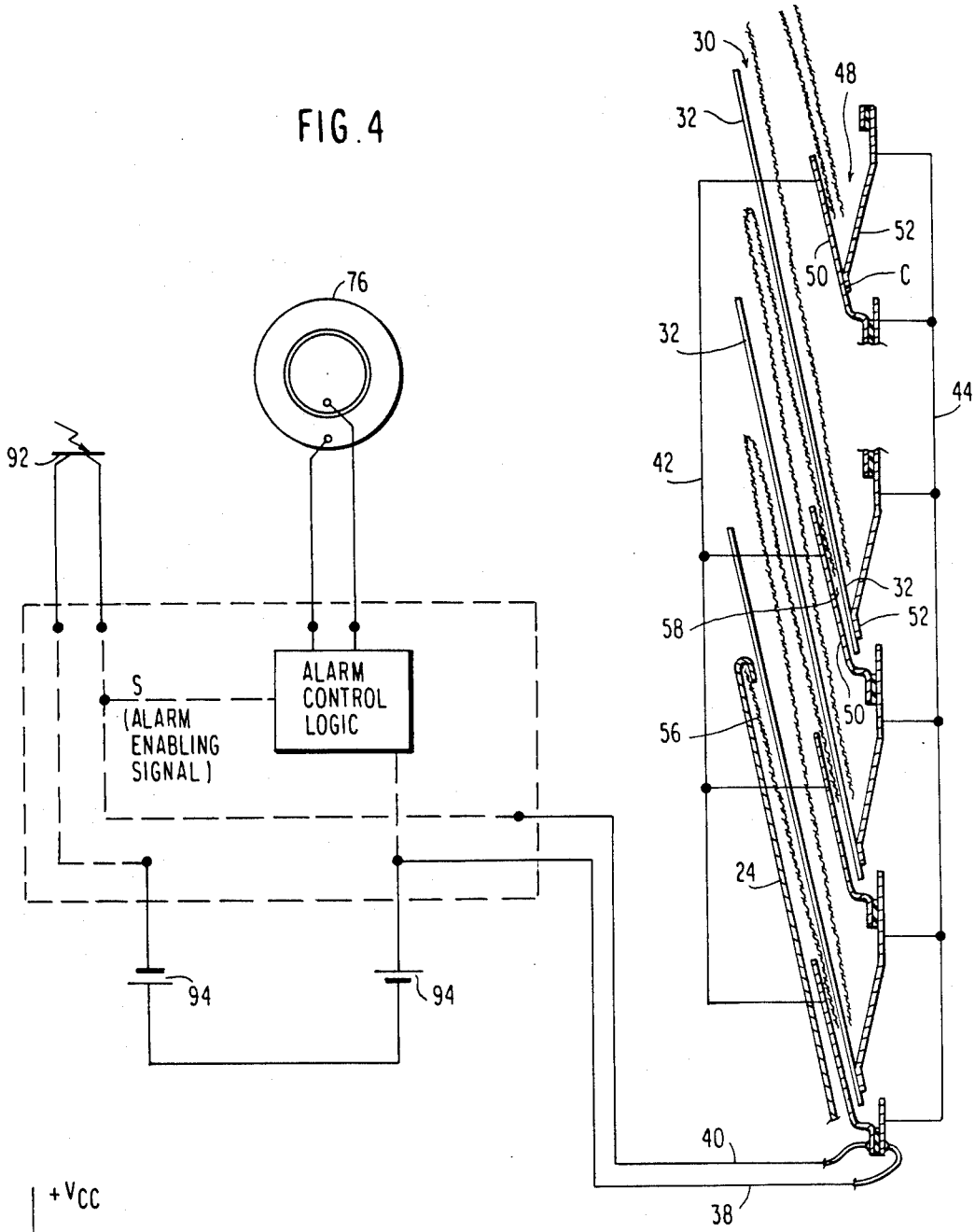
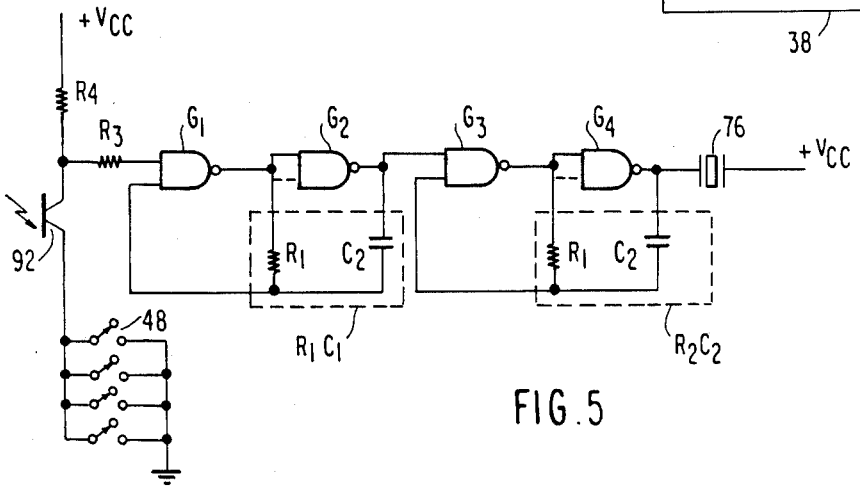
FIG. 5

CARD CARRIER HAVING AN ALARM

BACKGROUND OF THE INVENTION

1. Field of the Invention

The present invention pertains to card carriers such as wallets, and in particular to card carriers having means for indicating when a card is absent from the card carrier.

2. Description of Related Art

The advent of the credit card has revolutionized the manner in which consumer transactions are conducted. Credit card usage has become so pervasive that purchases of goods and services by credit card have become the preferred form of monetary transfer for many businesses and consumers. Purchases by credit card have become so popular in part because such purchases dispense with the need of the consumer to carry a considerable amount of cash. In addition, purchases by credit card have freed the consumer to make purchases on credit rather than deplete his or her existing cash resources.

Credit card usage, however, is not without its attendant drawbacks and risks. For example, in retail transactions involving the use of the card to make a purchase or to verify one's identification (such as is oftentimes required to write a check), the card is typically removed from the wallet and given to a salesperson. It is not uncommon during the course of such a transaction for the credit card to become misplaced or inadvertently left at the sales counter. The frequency of such occurrences increases in busy retail establishments, especially during the holidays. The failure of the owner to return the card to his or her wallet oftentimes goes unnoticed until she or he subsequently attempts to make another credit card-based transaction. The subsequent discovery of the absence of the credit card is both a nuisance to the card owner, who is unable in many instances to make the desired purchase, and a cause for concern, for the owner may not be able to readily recall where the card was left. Accordingly, it is desirable to provide a card carrier having a warning device which notifies the card owner of the absence of the card following completion of the credit transaction.

Wallets having alarms for indicating the absence of a credit card are known in the art. For example, U.S. Pat. No. 4,480,250 to McNeely discloses a credit card carrier, such as a wallet, which includes a pair of flaps foldable upon one another. Each of the flaps includes a plurality of clip switches arranged for receiving credit cards. The clip switches are arranged in parallel interconnection with one another, and in series interconnection between a battery and an alarm. When a credit card is removed from one of the clip switches, the circuit between the battery and the alarm is completed and the alarm is energized. The flaps include a proximity switch, such as a magnetic reed switch, which disables the alarm when the flaps are in an open position or, alternatively, enables the alarm circuit only when the flaps are folded upon each other. However, McNeely's alarm is triggered only when a card is missing from a pocket and the flaps are folded together. This arrangement suffers from the disadvantage that the alarm signal indicating the absence of a card is dependent upon the relative position of the wallet flaps. This dependency is not reliable in instances where the wallet is stored in a relatively large enclosure such as a purse having numerous other items stored therein which could prevent the flaps from coming together to complete the alarm circuit. In addition, a reed switch is mechanical and by its very nature is subject to failure or at least possible erratic behavior.

Another example of a credit card wallet alarm device is disclosed in U.S. Pat. No. 3,959,789 to McGahee. This patent discloses a check or credit card monitor consisting of a plurality of normally closed switches adapted to be held open by insertion of credit cards or similar items between the switch contacts. The contacts are connected in parallel to a timing mechanism adapted to energize a sensory alarm such as an audio signal, vibrator or light a predetermined time after closure of any one of the plurality of switches. Switch closure occurs upon the removal of the check or credit card from the monitor. This alarm arrangement, however, is not desirable because the alarm will sound during sales transactions in which the card is removed from the carrier for a period of time in excess of the predetermined time interval of the alarm circuit, thereby increasing the occurrence of false triggering of the alarm.

Other devices are known in the art which are designed to detect when an article has been accidentally lost or stolen. For example, U.S. Pat. No. 4,558,307 to Lienart discloses a reminder device which includes a photosensitive cell secured within a container. The container may be secured to an object such as a wallet in order to prevent accidental loss thereof. An electronic circuit is connected to the photosensitive cell and is fed by an electrical signal produced by the cell when the cell is irradiated by ambient light. The electronic circuit includes a delay circuit adapted to receive the signal and arranged to produce a control signal when the cell has been irradiated for a predetermined time interval. The electronic circuit is coupled to an audible signal generator which produces an audible alarm in response to the control signal. Because this device provides for the generation of an alarm signal after a predetermined time interval has passed, it, too is unsuitable for general use due to its susceptibility to trigger false alarm signals. Also, while perhaps being useful to detect loss of a whole wallet, this device would be impractical for detecting loss of an object such as a credit card since, among other reasons, it would be too bulky to attach to a credit card.

A self actuating wallet alarm is disclosed in U.S. Pat. No. 3,930,249 to Steck et al. The wallet includes an electronic circuit that emits an audible alarm when the wallet is removed from an owner's purse or pocket, and is designed to guard against pickpockets. The electronic circuit is coupled to an externally mounted photosensor which produces an electrical signal which drives the circuit and an alarm coupled thereto upon exposure of the photosensor to ambient light. When the photosensor is exposed to light below a predetermined threshold, such as when the wallet is included in an enclosure such as a pocket or purse, no electrical signal is generated for driving the circuit and the alarm. For reasons discussed above with respect to Lienart, using photocells attached to credit cards to detect their removal is impractical since the size requirements for credit cards prohibit attachment of photocells and associated circuitry thereto. Further, credit cards are frequently removed from wallets during ordinary use, and it makes no sense to have a photocell sound an alarm every time a credit card is removed.

As is evident from the above discussion of the related art, the known card carriers and other devices are unsuited to the demands and circumstances surrounding many credit card transactions consumers today contend with.

OBJECTS AND SUMMARY OF THE INVENTION

It is therefore a general object of the present invention to provide a card carrier which is an effective monitoring device for one or more credit cards normally stored within the carrier and to overcome the deficiencies of the known devices discussed above.

Another object of the present invention is to provide a credit card monitoring device which is of high quality yet is inexpensive to manufacture.

The foregoing and other objects are attained in accordance with each of the aspects of the invention detailed hereinbelow.

In one aspect of the invention, a card carrier is provided having means for receiving a card and for triggering an alarm when (i) the card is missing from the card carrier, and (ii) the card carrier is placed in one's pocket, purse or other enclosure. The means for receiving the card and for triggering the alarm includes pocket means normally adapted to receive a card therein, card sensing means associated with the pocket for detecting the presence or absence of the card therein, and enclosure sensing means for sensing when the card carrier is placed in one's pocket, purse or other enclosure. Alarm means operatively connected to the card sensing means and the enclosure sensing means an alarm signal is emitted when the card sensing means detects the absence of the card from the pocket means and the enclosure sensing means senses the card carrier is positioned in one's pocket, purse or other enclosure.

In a further aspect of rhe invention, the means for receiving a card and for triggering an alarm includes a flap having an inside wall portion and an outside wall portion. The pocket means is positioned on the inside wall portion and the enclosure sensing means is positioned adjacent the outside wall portion.

A further arrangement provides that the card sensing means comprises a clip switch adapted to grasp a portion of a card inserted into the pocket means. The clip switch includes two electrically conductive members and an insulator therebetween. One of the electrically conductive members resiliently engages the other conductive member to close an electrical contact when the card is removed from the pocket.

Another arrangement provides that the enclosure sensing means includes a photodetector for emitting a signal when the intensity of light incident thereto is below a predetermined threshold value. The alarm means includes a printed circuit board and an alarm in series interconnection with a battery, the card sensing means, and the enclosure sensing means. The printed circuit board interconnects the alarm, battery, and enclosure sensing means and includes a plurality of gates for providing an alarm signal having a predetermined duration and frequency. The gates are preferably arranged in a quad 2-input NAND gate configuration. The inputs include first and second resistor-capacitor circuits wherein the first RC circuit has a predetermined value to provide a desired alarm firing duration and the second RC circuit has a predetermined value to provide a desired frequency of signal emission A further aspect provides that the alarm means and the enclosure sensing means are arranged on a cassette. Apertures formed on one side of the cassette provide for communication between the exterior environment of the card carrier and the alarm and enclosure sensing means. Preferably, the cassette is positioned adjacent the outside wall portion of the flap. In card carriers having a pair of flaps, the cassette is positioned in one of the pair of flaps and the card sensing means is positioned in the other of the pair of flaps. The cassette and card sensing means are arranged within their respective flaps such that they do not substantially overlap when the flaps are folded toward one another. In a further preferred aspect of the invention, the alarm and the photodetector communicate with the exterior environment of the card holder through apertures formed in the exterior wall portion of the flap in which the alarm and photodetector are positioned so that the photodetector may sense the level of light in an enclosure in which the card carrier is positioned.

A further aspect of the invention provides that the pocket means includes a plurality of card pockets and the card sensing means is associated with each of the card pockets. The card sensing means includes a plurality of clip switches arranged in parallel interconnection with one another on a card plate. Each of the clip switches includes two electrically conductive members, one of which resiliently engages the other to close an electrical contact when the card is removed from the pocket. Preferably, the clip switches are arranged in columns and the clip switches comprising the columns are substantially aligned to minimize the width of the card plate and to minimize overlap with the cassette means.

BRIEF DESCRIPTION OF THE DRAWINGS

The foregoing and other objects, aspects, uses and advantages of the present invention will be more fully appreciated as the same become better understood from the following detailed description of the present invention when considered in conjunction with the accompanying drawings, in which:

FIG. 1 is a perspective view of a preferred embodiment of the card carrier of the present invention;

FIG. 2 is an elevational view of the interior of the preferred embodiment illustrated in FIG. 1, partially cut away;

FIG. 4 is a partial circuit diagram of the circuitry of the preferred embodiment;

FIG. 5 is a more detailed schematic diagram of the electronic components of the preferred embodiment of the present invention; and FIG. 6 is a partially exploded view of a portion of FIGS. 1 and 2.

DETAILED DESCRIPTION OF THE PREFERRED EMBODIMENT

Figure 3:
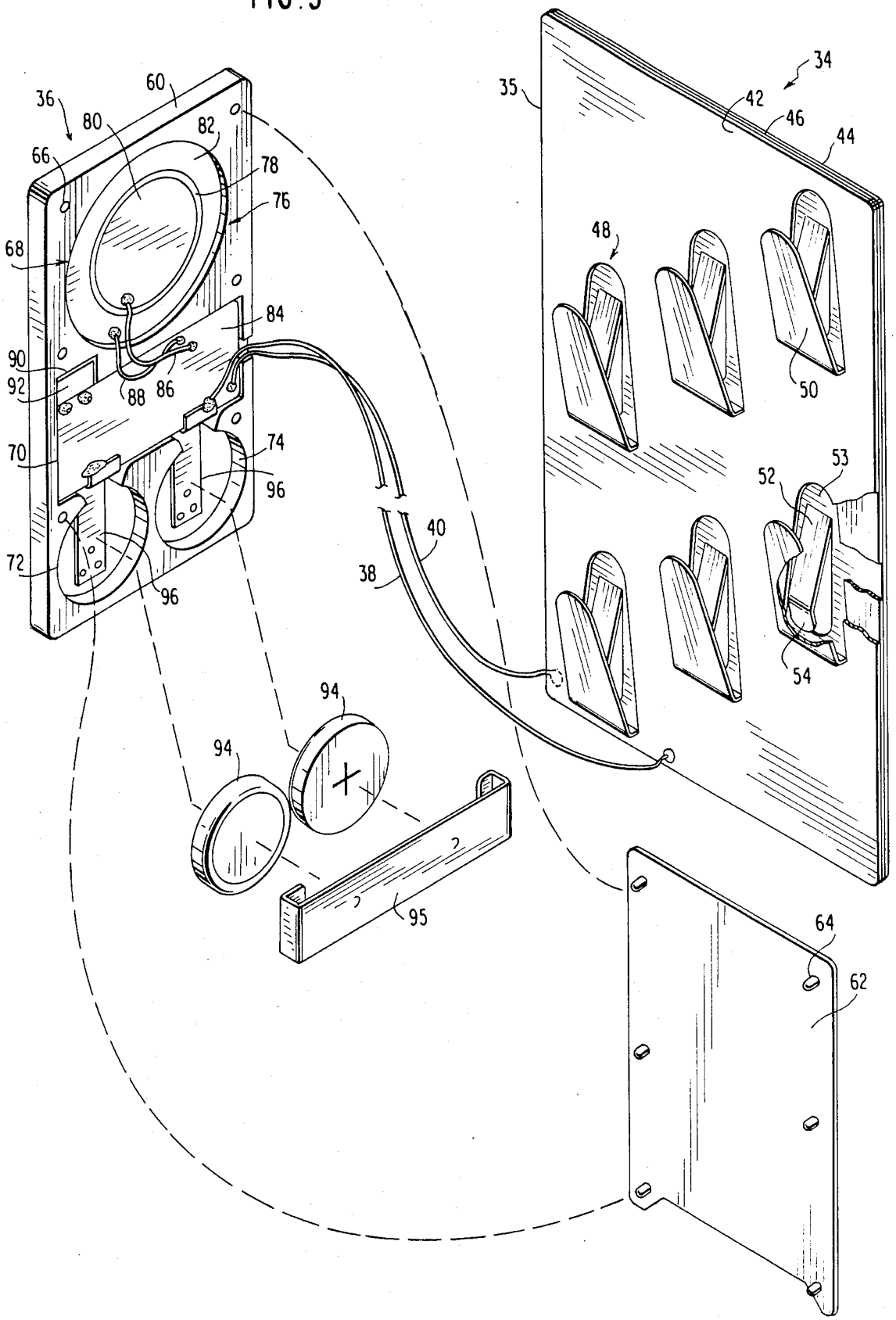
FIG. 3 is a detailed perspective view of certain major components of the preferred embodiment.

Referring now to the drawings, wherein like reference numerals represent identical or corresponding parts throughout the several views, and more particularly to FIGS. 1 and 2 thereof, a card carrier of the present invention is indicated generally by the reference numeral 10. More particularly, the card carrier 10 is illustrated in the form of a wallet 12 having first and second flaps 14, 16 connected to one another at a seam 18. Preferably, the flaps 14, 16 are continuous with one another and the seam 18 is in the form of a fold which permits the flaps 14, 16 to be folded toward one another to close the wallet.

The first flap 14 includes an outside wall portion 20 and an inside wall portion 22. Similarly, the second flap 16 includes an interior wall portion 24 and an exterior wall portion 25. The wallet 12 conventionally includes a currency receiving pocket 26 formed along an upper surface of the interior of the wallet. The first flap 14 may include a picture window 28 formed from a suitable transparent material for displaying a frequently used item, such as a form of personal identification, upon opening of the wallet 12.

The second flap 16 preferably includes a plurality of card receiving pockets 30. Each of the pockets 30 is configured to house a standard card item such as a credit card 32 therein. When a card 32 is inserted into one of the pockets 30, as shown in FIG. 2, the presence of the card 32 in the pocket 30 is detected by a card sensing mechanism 34 illustrated in phantom and to be described in greater detail hereinafter. The card sensing mechanism 34 is operatively interconnected with a cassette, depicted generally at 36, by a pair of electrical leads 38, 40. The cassette 36 is generally provided for housing electrical components of the wallet 12, which components will be described in detail below, and for positioning these components in a fixed position in the wallet.

With reference to FIG. 3, the preferred form of the card sensing mechanism 34 includes a clip plate 35 having a tri-laminate arrangement of an electrically conductive front plate 42, an electrically conductive back plate 44, and an insulator 46 therebetween. A plurality of clip switches 48 are formed in plates 42 and 44 and are each designed to engage a portion of a credit card 32. One clip switch 48 is provided for each of the card receiving pockets 30 for indicating the presence or absence of a card therein. Each clip switch 48 includes a tongue member 50 formed from the electrically conductive front plate 42 and extending outwardly therefrom, and a flange member 52 formed from the electrically conductive back plate 44. The flange member 52 extends through an opening 53 formed in the front plate 42 by the outwardly extending tongue member 50 to resiliently engage same to form an electrical contact C (FIG. 4) which is normally biased to a closed position. The flange member 52 preferably includes a downwardly turned end portion 54 which extends in a direction substantially parallel to tongue portion 50. It will be appreciated that when a card 32 is inserted into a pocket 30 and into engagement with a corresponding clip switch 48, the normally closed electrical contact C of the clip switch 48 is opened by the interposition of a portion of the card 32 between the respective contact surfaces of the tongue and flange members 50 and 52, respectively, as shown in the circled portion of FIG. 4. The clip switches 48 are preferably positioned in and extend through a slot 58 formed in a lower portion of the pocket 30 so that the card 32 must be substantially fully inserted into the pocket 30 in order to break the electrical contact C of the switch 48. The pockets 30 are otherwise conventional in nature and include a suitable lining material 56 such as nylon.

With reference again to FIG. 3, the cassette 36, which houses the major electrical components of the wallet 12 and orients these components in a fixed position with respect to the outside wall portion 20 of the flap 14, includes a housing portion 60 and a cover plate 62 which substantially covers a back portion of the cassette. The cover plate 62 is secured to the housing 60 in any suitable manner, as by lugs 64 extending therefrom which are adapted to be received by corresponding recesses 66 formed in the housing.

The housing 60 preferably includes an arrangement of four recesses 68, 70, 72, and 74. The recess 68 is positioned in an upper portion of the housing 60 and includes an alarm mechanism 76. The alarm mechanism 76 preferably comprises a piezoelectric crystal 78 mounted between two vibration plates 80 and 82. The recess 70 extends across the width of a middle portion of the cassette 60 and houses a printed circuit board 84. Electric leads 86 and 88 extend between the printed circuit board 84 and the vibration plates 80 and 82, respectively, of the alarm 76. Positioned adjacent the printed circuit board 84 in an auxiliary recess 90 is enclosure sensing mechanism 92. Preferably, the enclosure sensing mechanism is a photocell such as a phototransistor. The phototransistor 92 receives light input from the external environment of the wallet 12 to provide signal input to the alarm mechanism in a manner to be described below in detail.

The recesses 72, 74 are positioned along a lower end of the cassette 60 and are adapted to receive batteries 94. The batteries 94 are connected to the printed circuit board 84 by battery terminals 96 extending between the board 84 and each of the recesses 72, 74. The card sensing mechanism 34, alarm mechanism 76, enclosure sensing mechanism 92 and batteries 94 are all interconnected in series through the printed circuit board 84. The batteries 94 are secured within their respective recesses 72, 74 by a securing clip 95 adapted to slide over the lower end of the cassette 60 and over the batteries. The securing clip 95 also functions as an electrical contact for connecting the batteries in series.

FIGS. 4 and 5 illustrate in schematic form a diagram of a circuit useful in connection with the credit card carrier of the present invention. In accordance with the invention, an alarm signal is emitted only when one or more of the clip switches 48 are closed, that is, when one or more of the cards 32 is missing, and when the enclosure sensing device (phototransistor 92) is exposed to light that is sufficiently dim.

The clip switches 48 are preferably arranged in parallel interconnection with one another and in series interconnection with the remainder of the circuit through the printed circuit board 84. Phototransistor 92, as understood by those of skill in the art, has an impedance which drops as the level of light incident thereon diminishes, such that the photoconductor produces an alarm enabling signal S (FIG. 4) when the level of light incident thereto is below a predetermined threshold value. Thus, current flows from the junction of resistors $R_4$ and $R_3$ (FIG. 5) and ground when the phototransistor 92 is darkened below the predetermined threshold value, and one of the clip switches 48 is closed. Closure of a clip switch 48 occurs when a card 32 is removed from one of the pockets 30 and therefore no longer interposes between tongue 50 and flange 52 of clip switch 48, as noted at the closed contact C in FIG. 4. The enabling signal S thus provided is then processed by a quad 2-input NAND gate comprising gates $G_1$, $G_2$, $G_3$, and $G_4$ to sound an alarm by activating the alarm 76. Resistor-capacitor networks $R_1C_1$ and $R_2C_2$ control the duration and audible frequency of the sound emitted by the alarm 76. In a preferred embodiment, the values of the components of $R_1$ and $C_1$ are $R_1 = 7.5\ M\Omega$ and $C_1=0.047$ μf; $R_2$ $C_2$ comprises $R_2=75$ kΩ and $C_2=0.001$μf. The circuit is completed by $R_4=820$ KΩ and $R_3=1.2$ MΩ.

It will be appreciated that the use of the quad 2-input NAND gate, which may comprise a simple chip, for controlling both the duration and frequency of the audible alarm, is an extremely inexpensive, power and space-efficient manner in which to determine these parameters. It will also be appreciated that the arrangement of the batteries 94, alarm 76, phototransistor 97, and circuit board 84 on the cassette 36 also represents an exceedingly space efficient manner in which to assemble these components for use in the invention described herein.

The cassette 36 is preferably placed adjacent the outside wall portion of the flap in which it is arranged so that the phototransitor 92 is positioned to receive light input from the exterior environment of the wallet. In instances where two or more flaps are provided for the wallet, as is the case with the bi-fold type of wallet depicted in FIGS. 1 and 2, the cassette 36 is preferably positioned adjacent the outside wall portion of one of the outwardly exposed flaps (i.e., not the enclosed flap of a tri-fold type of wallet) to provide a more accurate indication of the intensity of light surrounding the wallet. In such multi-flap wallet arrangements, the cassette 36 is preferably positioned in a flap other than that which includes the arrangement of pockets 30 so as to provide for a more compact wallet upon closure of the flaps.

As illustrated in FIG. 6, the cassette 36 is oriented with respect to the flap 14 such that the front end 98 of the cassette is facing the exterior 20 of the flap. The front end 98 of the cassette 36 includes an aperture 100 and an opening 102. The aperture 100 is substantially aligned with the alarm 76 so as to facilitate conduction of the audible alarm signal when triggered. The opening 102 is positioned adjacent the phototransistor 92 to permit light to reach the phototransistor.

The position of the cassette 36 with respect to the outside wall 20 of the flap 14 is secured by a sheet 104 positioned therebetween. The sheet 104 is provided with an adhesive along one surface thereof for adhesively securing the front end 98 of the cassette 36 thereto. A pair of annular openings 106 are formed in sheet 104 and are substantially aligned with aperture 100 and opening 102 of cassette 36 when the cassette is secured to the sheet. Corresponding annular passages 108 are formed in the outside wall portion 20 of the flap 14 and are in turn substantially aligned with clip openings 110 formed in a retaining clip 112. The retaining clip 112 includes a plurality of prongs 114 which are provided to secure the position of sheet 104 with respect to the outside wall portion 20 of the flap. The prongs 114 extend through slits 116 formed in wall 20 of flap 14 and corresponding slit openings 118 formed in sheet 104. When the cassette 36, sheet 104 and wall 20 are substantially aligned, prongs 114 of clip 112 are bent backward so as to secure the position of the cassette 36 within the flap 14. Preferably, the cassette 36 is oriented within the flap 14 such that it does not substantially overlap with the card sensing means 34 mounted in the other flap 16. To further facilitate the compact arrangement of the alarm wallet 12, the clip switches 48 are arranged in columns so that clip switches of the same column are substantially aligned and the width of the clip plate 35 is minimized, as shown in FIGS. 2 and 3.

OPERATION OF THE INVENTION

The novel card carrier described hereinabove is provided to lessen the occurrence of card loss or misplacement arising out of, e.g., retail purchase transactions. In accordance with this and other objectives detailed above, the card carrier or wallet 12 is arranged so that each of the card receiving pockets 30 includes a card 32 such as a credit card. Upon the removal of one or more cards from the pockets, as typically occurs during the course of a customer purchase on credit, the circuit C at the corresponding clip switch 48 is closed by resilient engagement of the flange member 52 against the tongue member 50 of the switch. Closure of one or more clip switches 48 places the alarm means in an enabling mode. Replacement of all of the cards into their respective pockets, which normally occurs at the end of the transaction, disables the alarm means. However, if the customer forgets or otherwise fails to replace any of the cards 32 into its corresponding pocket 30 and places the wallet into an enclosure such as a pocket or purse, an alarm enabling signal S is generated by the phototransistor 92 sensing the diminished level of light of the enclosure and an alarm signal (preferably audible) is generated, thus providing a reminder to the card owner that the card is absent from the wallet. No alarm signal is generated when the card is returned to the corresponding pocket and the wallet is placed in the enclosure, because return of the card 32 to its corresponding pocket 30 opens the circuit C of the clip switch 48 positioned along a lower end of the pocket. Absent closure of a circuit C at any of the clip switches 48, the alarm logic control, i.e., printed circuit board 84 (FIGS. 4 and 5) does not place the alarm means in an enabling mode, even though an alarm enabling signal S may be generated by the phototransistor 92. Accordingly, an alarm signal is produced only when a card has been removed from one of the pockets (thereby closing the contact C at the corresponding clip switch 48) and the phototransistor produces an enabling signal S in response to placement of the wallet in one's pocket, purse, or other enclosure.

Obviously, numerous modifications and variations of the present invention are possible in light of the above teachings. It is therefore to be understood that, within the scope of the appended claims, the invention may be practiced otherwise than as specifically described herein.

What is claimed is:

1. A card carrier, comprising:

means for receiving a card and for triggering an alarm when (i) the card is missing from the card carrier, and (ii) the card carrier is placed in one's pocket, purse, or other enclosure; and location sensing means for generating a signal responsive to the disposition of the card carrier in one's pocket, purse or other enclosure.

2. The card carrier recited in claim 1, wherein said receiving means and said alarm triggering means comprises:

pocket means normally adapted to receive a card therein;

card sensing means associated with said pocket means for detecting the presence or absence of the card therein; and alarm means operatively connected to said card sensing means and said location sensing means for emitting a signal when said card sensing means detects the absence of the card from said pocket means and said location sensing means senses the card carrier is positioned in said pocket, purse, or other enclosure.

3. The card carrier recited in claim 2, wherein said means for receiving a card and for triggering an alarm comprises a flap having an inside wall portion and an outside wall portion, said pocket means being positioned on said inside wall portion and said enclosure sensing means being positioned adjacent said outside wall portion.

4. The card carrier recited in claim 2, wherein said card sensing means comprises a clip switch adapted to grasp a portion of a card inserted into said pocket means.

5. The card carrier recited in claim 4, wherein said clip switch comprises two electrically conductive members and an insulator therebetween, one of said electrically conductive members resiliently engaging the other to close an electrical contact when the card is removed from said pocket means.

6. The card carrier recited in claim 4, wherein said clip switch is arranged on a clip plate, said clip plate comprising electrically conductive front and back plates and an insulator therebetween, said clip switch comprising a tongue member formed from one of said conductive plates and a flange member formed from the other of said conductive plates, one of said members resiliently engaging the other of said members to close the switch when the card is not positioned therebetween.

7. The card carrier recited in claim 2, wherein said location sensing means comprises a photodetector for emitting an alarm enabling signal when the intensity of light incident thereto is below a predetermined threshold value.

8. The card carrier recited in claim 7, wherein said photodetector comprises a phototransistor.

9. The card carrier recited in claim 2, wherein said alarm means of said alarm triggering means comprises an alarm in series interconnection with a battery, said card sensing means, and said location sensing means.

10. The card carrier recited in claim 9, wherein said alarm means further comprises a printed circuit board, said alarm, said battery, and said location sensing means being interconnected through said printed circuit board.

11. The card carrier recited in claim 10, wherein said printed circuit board includes a plurality of gates for providing said alarm signal, said alarm signal having a predetermined duration and frequency.

12. The card carrier recited in claim 11, wherein said gates are arranged in a quad 2-input NAND gate configuration, said inputs including first and second resistor-capacitor circuits, said first RC circuit having a predetermined value to provide said predetermined duration and said second RC circuit having a predetermined value to provide said predetermined frequency.

13. The card carrier recited in claim 10, further comprising cassette means for housing said alarm means and said location sensing means.

14. The card carrier recited in claim 13, wherein said alarm and said location sensing means communicate with the exterior environment of said card holder through apertures formed on one side of said cassette.

15. The card carrier recited in claim 2, further comprising cassette means for housing said alarm means and said location sensing means.

16. A card carrier, comprising:

means for receiving a card and for triggering an alarm when (i) the card is missing from the card carrier, and (ii) the card carrier is placed in one's pocket, purse, or other enclosure, said means comprising:

(a) a pair of interconnected flaps, each of said flaps having an inside wall portion and an outside wall portion;

(b) pocket means adapted to receive a card positioned therein on the inside wall of one of said pair of flaps;

(c) card sensing means associated with said pocket means for detecting the presence or absence of the card therein;

(d) location sensing means adjacent the outside wall portion of one of said pair of flaps for providing a signal responsive to disposition of the card carrier in one's pocket, purse, or other enclosure; and (e) alarm means operatively connected to said card sensing means and said enclosure sensing means, said alarm means being being enabled when said card sensing means detects the absence of the card from said pocket means and said location sensing means senses that the card carrier is positioned in one's pocket, purse, or other enclosure.

17. The card carrier recited in claim 16, wherein said card sensing means comprises a clip switch adapted to grasp a portion of a card inserted into said pocket means, said clip switch comprising two electrically conductive members and an insulator therebetween, one of said electrically conductive members resiliently engaging the other of the conductive members to close an electrical contact when the card is removed from said pocket means.

18. The card carrier recited in claim 17, wherein said clip switch is arranged on a clip plate, said clip plate comprising electrically conductive front and back plates and an insulator therebetween, said clip switch comprising a tongue member formed from one of said conductive plates and a flange member formed from the other of said conductive plates, one of said member resiliently engaging said tongue member to close the switch when the card is not positioned therebetween.

19. The card carrier recited in claim 16, wherein said pocket means includes a plurality of card pockets, said card sensing means being associated with each of said card pockets.

20. The card carrier recited in claim 19, wherein said card sensing means comprises a plurality of clip switches arranged on a card plate, said clip switches being arranged in parallel interconnection with one another.

21. The card carrier recited in claim 20, wherein each of said clip switches comprises two electrically conductive members, one of said members resiliently engaging the other of said members to close an electrical contact when the card is removed from the pocket.

22. The card carrier recited in claim 16, wherein said location sensing means comprises a photodetector for emitting a signal when the intensity of light incident thereto is below a predetermined threshold value.

23. The card carrier recited in claim 22, wherein said photodetector includes a phototransistor.

24. The card carrier recited in claim 16, wherein said pocket means is positioned on said inside wall portion of one of said flaps and said location sensing means is positioned on said outside wall portion of one of said flaps.

25. The card carrier recited in claim 16, wherein said alarm means comprises an alarm in series interconnection with a battery, said card sensing means, and said location sensing means.

26. The card carrier recited in claim 25, wherein said alarm means further comprises a printed circuit board, said alarm, said battery and said location sensing means being interconnected through said printed circuit board.

27. The card carrier recited in claim 26, wherein said printed circuit board includes a plurality of gates for providing an alarm signal having a predetermined duration and a predetermined frequency.

28. The card carrier recited in claim 27, wherein said gates are arranged in a quad 2-input NAND gate configuration, said inputs including first and second resistor-capacitor circuits, said first RC circuit having a predetermined value to provide said predetermined alarm duration and said second RC circuit having a predetermined value to provide said predetermined frequency emitted by said alarm means.

29. The card carrier recited in claim 16, further comprising cassette means for housing said alarm means and said location sensing means.

30. The card carrier recited in claim 29, wherein said cassette means and said card sensing means do not substantially overlap when said flaps are folded toward one another.

31. A card carrier, comprising:

means for receiving a card and for triggering an alarm when (i) the card is missing from the card carrier, and (ii) the card carrier is placed in one's pocket, purse, or other enclosure, said means comprising:

(a) a pair of flaps connected together at a foldable seam, each of said flaps having an interior wall portion and an exterior wall portion;

(b) pocket means including a plurality of card receiving pockets positioned on said interior wall portion of one of said pair of flaps, each of said card pockets being adapted to receive a card therein;

(c) card sensing means including a plurality of clip switches arranged in parallel interconnection with one another, each of said plurality of clip switches being associated with a corresponding card pocket for detecting the presence or absence of a card therein;

(d) a photodetector positioned adjacent said exterior wall portion of one of said pair of flaps for sensing when the card carrier is placed in one's pocket, purse, or other enclosure; and (e) alarm means operatively interconnected to said card sensing means and said photodetector, said alarm means being enabled when said card sensing means detects the absence of the card from one of said plurality of card pockets and said photodetector senses the carrier is positioned in said pocket, purse, or other enclosure.

32. The card carrier recited in claim 31, wherein said clip switches are arranged on a clip plate comprising electrically conductive front and back plates separated from one another by an insulator, each of said clip switches comprising a tongue member formed from one of said conductive plates and a flange member formed from the other of said conductive plates, said flange member resiliently engaging said tongue member to close the switch when the card is not positioned therebetween.

33. The card carrier recited in claim 31, wherein said alarm means comprises an alarm in series interconnection with a battery, said card sensing means, and said photodetector.

34. The card carrier recited in claim 33, further comprising cassette means, said alarm means further comprising a printed circuit board, said alarm, said battery, and said photodetector being interconnected through said printed circuit board, wherein said alarm means and said photodetector are arranged on said cassette.

35. The card carrier recited in claim 34, wherein said clip switches are arranged in at least two columns on a clip plate, said clip switches being substantially aligned for minimizing the width of said clip plate and for minimizing overlap between said clip plate and said cassette when said flaps are folded toward one another.

36. The card carrier recited in claim 35, wherein said photodetector and said card sensing means are not positioned on the same flap.

37. The card carrier recited in claim 35, wherein said printed circuit board includes a plurality of gates arranged in a quad 2-input NAND gate configuration for providing an alarm signal having a predetermined duration and frequency.

38. The card carrier recited in claim 37, wherein said inputs including first and second resistor-capacitor circuits, said first RC circuit having a predetermined value to provide said predetermined duration and said second RC circuit having a predetermined value to provide said predetermined frequency.

39. The card carrier recited in claim 33, wherein said alarm and said photodetector communicate with the exterior environment of said card holder through corresponding apertures formed in said exterior surface of said flap.

40. The card carrier recited in claim 31, wherein said photodetector and said card sensing means are not positioned on the same flap.

* * * * *